United States Patent [19]

Demi

[11] 4,243,374

[45] Jan. 6, 1981

[54] FLUID FLOW SENSING SWITCH DEVICE AND METHOD OF MAKING THE SAME

[75] Inventor: Roy C. Demi, Greensburg, Pa.

[73] Assignee: Robertshaw Controls Company, Richmond, Va.

[21] Appl. No.: 936,114

[22] Filed: Aug. 23, 1978

[51] Int. Cl.[3] ..... F23N 1/00

[52] U.S. Cl. ..... 431/89; 137/613; 200/83 N; 200/83 Q

[58] Field of Search ..... 431/89; 200/81.9 R, 200/83 Q, 83 A, 83 N, 83 Y; 137/613

[56] References Cited

U.S. PATENT DOCUMENTS

| | | | |
|---|---|---|---|
| 2,071,042 | 2/1937 | Maurer | 200/83 N |
| 2,919,320 | 12/1959 | Edwards, Jr. et al. | 200/83 N |
| 3,005,888 | 10/1961 | Pütz | 200/83 Q |
| 3,603,708 | 9/1971 | Good | 431/45 |
| 3,825,029 | 7/1974 | Genbauffe | 137/505 |
| 3,898,403 | 8/1975 | Grayson et al. | 200/83 Q |
| 4,111,640 | 9/1978 | Scott | 431/46 |

*Primary Examiner*—Carroll B. Dority, Jr.
*Assistant Examiner*—Lee E. Barrett
*Attorney, Agent, or Firm*—Candor, Candor & Tassone

[57] ABSTRACT

A fluid flow sensing switch device having a housing provided with a fluid flow passage therethrough defined by an inlet and an outlet disposed in spaced coaxially aligned relation in the housing and separated by a valve seat controlled by a movable valve member that is operated by the pressure differential between the inlet and the outlet, the device having an electrical switch construction operatively associated with the valve member and having the switch contacts thereof actuated by the pressure differential. A pressure regulator is disposed in the housing for regulating the pressure of the fluid that passes from the inlet to the outlet of the housing, the pressure regulator being disposed downstream from the main valve seat so as to act on the fluid after the same passes through the main valve seat from the inlet. The pressure regulator has a valve seat and a valve member for controlling the valve seat thereof, the valve seat of the pressure regulator and the main valve seat being disposed in spaced coaxially aligned relation in the housing and substantially transverse to the coaxially aligned inlet and outlet.

18 Claims, 7 Drawing Figures

FLUID FLOW SENSING SWITCH DEVICE AND METHOD OF MAKING THE SAME

BACKGROUND OF THE INVENTION

1. Field of the Invention

This invention relates to an improved fluid flow sensing switch device and method of making the same as well as to a fuel control system utilizing such device for controlling the operation of electrical ignition means for a burner means of the fuel control system.

2. Prior Art Statement

It is known to applicant to provide in a fuel control system, a fluid flow sensing switch device having a housing means provided with a fluid flow passage therethrough defined by an inlet and an outlet separated by a valve seat controlled by a movable valve member that is operated by the pressure differential between the inlet and the outlet, the device having an electrical switch construction operatively associated with the valve member and having contact means thereof actuated by the pressure differential. A pressure regulator is provided for such system and is disposed intermediate such fluid flow sensing switch device and the burner means that receives fuel from the fluid flow sensing switch device.

For example, see the following co-pending U.S. Patent Application: (1) Ser. No. 936,112 filed Aug. 23, 1978.

The fluid flow sensing switch device of Item (1) above has one contact of the electrical switch construction carried by a flexible diaphragm that actuates the switch construction and the movement of the valve member by sensing the pressure differential between the inlet and the outlet across the same, and has the other contact of the switch construction carried on the valve member to be contacted by the diaphragm contact when the diaphragm moves its contact against the valve member contact so that the switch construction will be closed before the diaphragm can move the valve member to an open position thereof.

In the system of Item (1) above, such fluid flow sensing switch device is utilized in combination with a pressure regulator that is disposed intermediate the fluid flow sensing switch device and the burner means that receives fuel therefrom so that the fuel will be at a proper pressure valve when received by the burner means.

It was found according to the teachings of applicant's copending patent application, Ser. No. 936,113 filed Aug. 23, 1978, that the contact means of the electrical switch construction of Item (1) above can be arranged and comprise a pair of spaced apart contacts carried by the flexible diaphragm and a bridging contact member carried by the valve member and being adapted to make contact with the pair of contacts and thereby bridge the pair of contacts to close the switch construction.

It is also known to applicant to provide an electronic switching circuit to be controlled by the switch construction of such a fluid flow sensing switch device so that a relatively small current flow can be controlled by the switch construction of the fluid flow sensing switch device to eliminate any build up of carbon on the contacts thereof while permitting the electronic switching means to control a large current flow for operating the burner ignition means.

For example, see the following copending U.S. patent application: (2) Ser. No. 936,116, filed Aug. 23, 1978.

SUMMARY OF THE INVENTION

It is a feature of this invention to provide a fluid flow sensing switch device that is relatively compact while being relatively easy to manufacture and assemble.

In particular, it was found according to the teachings of this invention that the aforementioned prior known fluid flow sensing switching devices each requires a separate pressure regulator to be utilized in combination therewith in the fuel control system utilizing such fluid flow sensing switch device.

However, it was found according to the teachings of this invention, that a pressure regulator means could be disposed in the same housing means of the fluid flow sensing switch device in such a manner that the resulting self-contained housing means still could be substantially the same size as the housing means of the prior known fluid flow sensing switch device so that a considerable savings in materials would be provided by disposing two control devices in a single self-contained housing and a savings would be provided in the manufacturing costs of a system utilizing the same.

In particular, one embodiment of this invention provides a fluid flow sensing switch device having a self-contained housing means provided with a fluid flow passage therethrough defined by an inlet and an outlet disposed in spaced coaxially aligned relation in the housing means and separated by a main valve seat controlled by a movable main valve member that is operated by the pressure differential between the inlet and the outlet, the device having an electrical switch construction operatively associated with the main valve member and having contact means thereof actuated by the pressure differential. A pressure regulator means is disposed in the housing means for regulating the pressure of the fluid that passes from the inlet to the outlet of the housing means, the pressure regulator means being disposed downstream from the main valve seat so as to act on the fluid after the same passes through the main valve seat from the inlet. The pressure regulator means has a valve seat and a valve member for controlling the valve seat thereof, the valve seat of the pressure regulator means and the main valve seat being disposed in spaced coaxially aligned relation in the housing means and substantially transverse to the coaxially aligned inlet and outlet.

The contact means of such fluid flow sensing switch device can comprise a pair of spaced apart contacts carried by a flexible diaphragm and a bridging contact member carried by the main valve member and being adapted to make contact with the pair of contacts and thereby bridge the pair of contacts to close the switch construction, the diaphragm moving the valve member by having the pair of contacts thereof engage the bridging contact member and move the same therewith as the bridging contact member is secured to the main valve member.

Accordingly, it is an object of this invention to provide an improved fluid flow sensing switch device having one or more of the novel features of this invention as set forth above or hereinafter shown or described.

Another object of this invention is to provide a method of making such a fluid flow sensing device, the method of this invention having one or more of the novel features of this invention as set forth above or hereinafter shown or described.

Another object of this invention is to provide a fuel control system utilizing such a fluid flow sensing switch device, the fuel control system of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
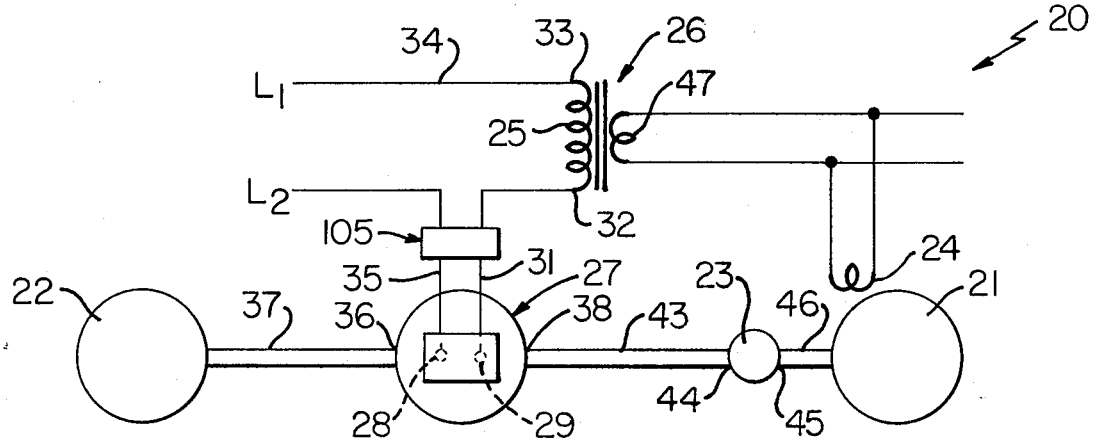
FIG. 1 is a schematic view illustrating the fuel control system of this invention that includes the fluid flow sensing switch device of this invention.
Figure 2:
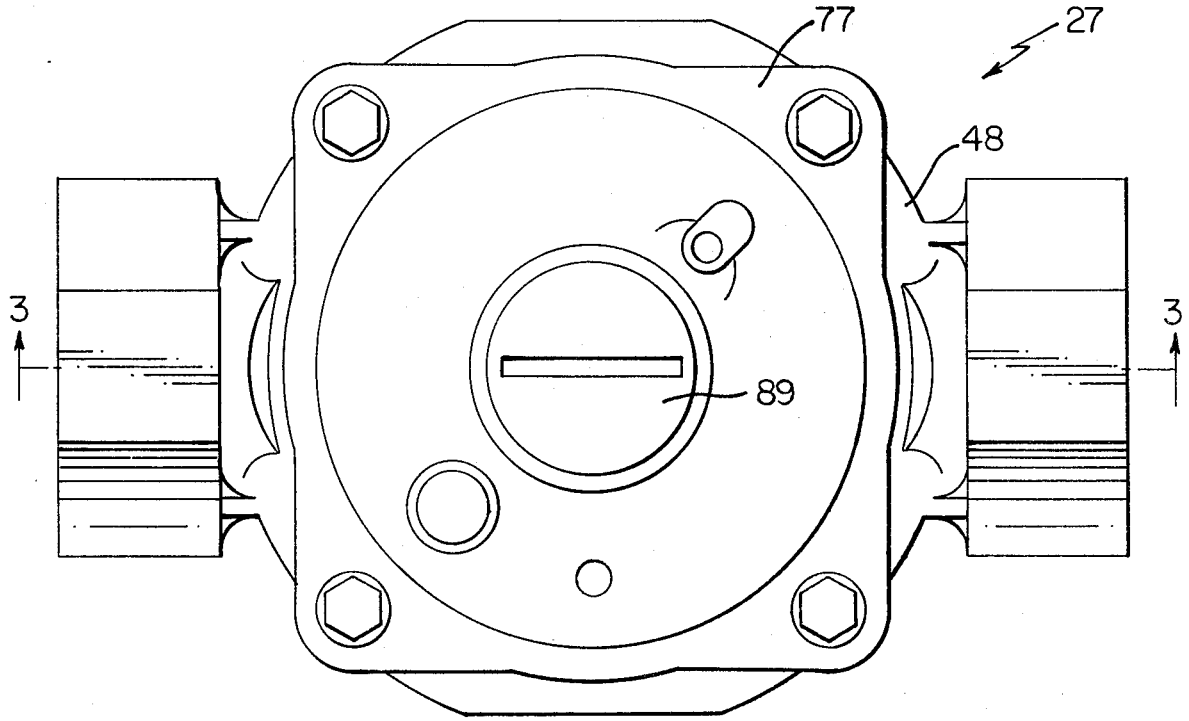
FIG. 2 is an enlarged top view of the fluid flow sensing switch device of this invention that is schematically illustrated in FIG. 1.

While the various features of this invention are hereinafter described and illustrated as being particularily adapted to provide a fluid flow sensing switch device for a fuel control system, such as for a cooking apparatus or the like, it is to be understood that the various features of this invention can be utilized singly or in any combination thereof to provide a fluid flow sensing switch device for other types of apparatus as desired.

Therefore, this invention is not be limited to only the embodiment illustrated in the drawings, because the drawings are merely utilized to illustrate one of the wide variety of uses of this invention.

Referring now to FIG. 1, the improved fuel control system of this invention is generally indicated by the reference numeral 20 and is being utilized for controlling the operation of a main burner means 21 of a cooking apparatus or the like (not shown) that is adapted to receive gaseous fuel from a fuel source 22 when a conventional "on-off" valve 23 for the burner means 21 is turned an "on" condition thereof whereby the fuel issuing from the burner means 21 is adapted to be ignited by an electrically operated ignitor coil 24 disposed adjacent thereto and being energized when electrical current is permitted to flow through a primary coil 25 of a transformer means 26 of this invention caused by electrical connection between a pair of terminal means 28 and 29 of an electrical switch construction 30 thereof (FIG. 3) upon the sensing of a flow of fuel from the device 27 toward the burner means 21 in the manner hereinafter described.

The terminal 29 of the switch construction 30 is adapted to be electrically interconnected by a lead means 31 to one side 32 of the primary coil 25 of the transformer means 26 while the other side 33 of the primary coil 25 is interconnected by a lead means 34 to a main power source lead L1.

The other terminal means 28 of the switch construction 30 is adapted to be interconnected by a lead means 35 to the other main power source lead L2 as illustrated in FIG. 1.

If desired, an electronic switching unit that is generally indicated by reference numeral 105 in FIGS. 1 and 7 can be disposed in the lead means 31 and 35 for a purpose hereinafter described or such electronic switching unit 105 can be disposed inside the device 27 as hereinafter described and as set forth in the aforementioned copending patent application Ser. No. 936,113.

The fuel source 22 is adapted to be interconnected to the inlet side 36 of the fluid flow sensing switch device 27 of this invention by a conduit means 37 while the outlet side 38 of the device 27 is adapted to be interconnected by a conduit means 43 to the inlet side 44 of the "on-off" valve 23 that has its outlet side 45 interconnected by a conduit means 46 to the burner 21.

In the similar systems of all of the aforementioned copending patent application, a separate pressure regulator is disposed in the conduit means 43. However, as will be apparent hereinafter, the device 27 of this invention includes a pressure regulator means therein so that pressure of the fuel permitted to reach the burner means 21 will be at the proper pressure valve. The pressure regulator means of this invention is generally indicated by the reference numeral 40 in FIGS. 2–6.

While the system 20 is illustrated as having only one burner 21 and one ignitor coil 24 respectively therefor, it is to be understood that the system 20 could have a plurality of burners 21 and each have an ignitor coil 24 therefor that is also electrically interconnected to a secondary winding 47 of the transformer means 26 in any suitable manner.

For example, the ignition coil 24 can be of the type set forth in the U.S. Patent to Branson, No. 4,003,360 or set forth in the U.S. Patent to Grayson et al, No. 3,898,403.

In any event, it can be seen that the fuel control system 20 is so constructed and arranged that each time the "on-off" valve 23 is turned to an "on" condition thereof, fuel is adapted to flow from the fuel source 22 to the burner 21, the device 27 of this invention being so constructed and arranged in a manner hereinafter set forth that the same senses the opening of the valve 23 in a manner to cause the terminal means 28 and 29 to be electrically interconnected together to operate the ignitor 24 before the device 27 permits fuel to flow therethrough from the source 22 to the burner means 21. In this manner, by the time the fuel flows through the device 27 to the burner means 21 to issue therefrom, the ignition coil 24 is already operating to ignite the fuel flow from the burner 21.

The ignitor coil 24 remains in an energized condition thereof as long as the fuel continues to flow from the source 22 through the device 27 to the burner 21 as will be apparent hereinafter.

Thereafter, when the operator closes the "on-off" valve 23, the device 27, sensing the closing of the valve means 23 in a manner hereinafter set forth, subsequently not only disconnects the conduits 37 and 43 from each other, but also disconnects the terminals 28 and 29 of the switch construction 30 to terminate the operation of the ignition coil 24.

The details of the improved fluid flow sensing switch device 27 of this invention and the method of this invention for making the same will now be described and reference is made to FIGS. 3–6 wherein it can be seen that the device 27 has a self-contained housing means 48 that includes an inlet 49 and an outlet 50 separated from each other by a resilient valve seat 51 that is adapted to be opened and closed by a valve member 52 movably carried by the housing 48 in a manner hereinafter described.

In this manner, the inlet 49 and outlet 50 provide a fluid flow path through the housing means 48 adapted to be respectfully interconnected to the conduits 37 and 43 for the purpose previously described.

A flexible diaphragm 53 has its outer peripheral portion 54 secured to the housing means 48 by being held between a main body part 55 thereof and a cover plate 56 thereof fastened to the body part 55 by threaded fastening means 57 whereby the side 58 of the flexible diaphragm 53 cooperates with the housing part 55 to define part of the inlet 49 thereof and the other side 59 of the flexible diaphragm 53 cooperates with the cover part 56 to define a control chamber 60 therewith that is sealed from the outlet 50 by the flexible diaphragm 53.

A compression spring 61 is disposed in the control chamber 60 and has one end 62 bearing against the cover member 56 and the other end 63 thereof bearing against the diaphragm 53 to tend to urge the diaphragm 53 upwardly in FIG. 3 for a purpose hereinafter described.

Figure 4:
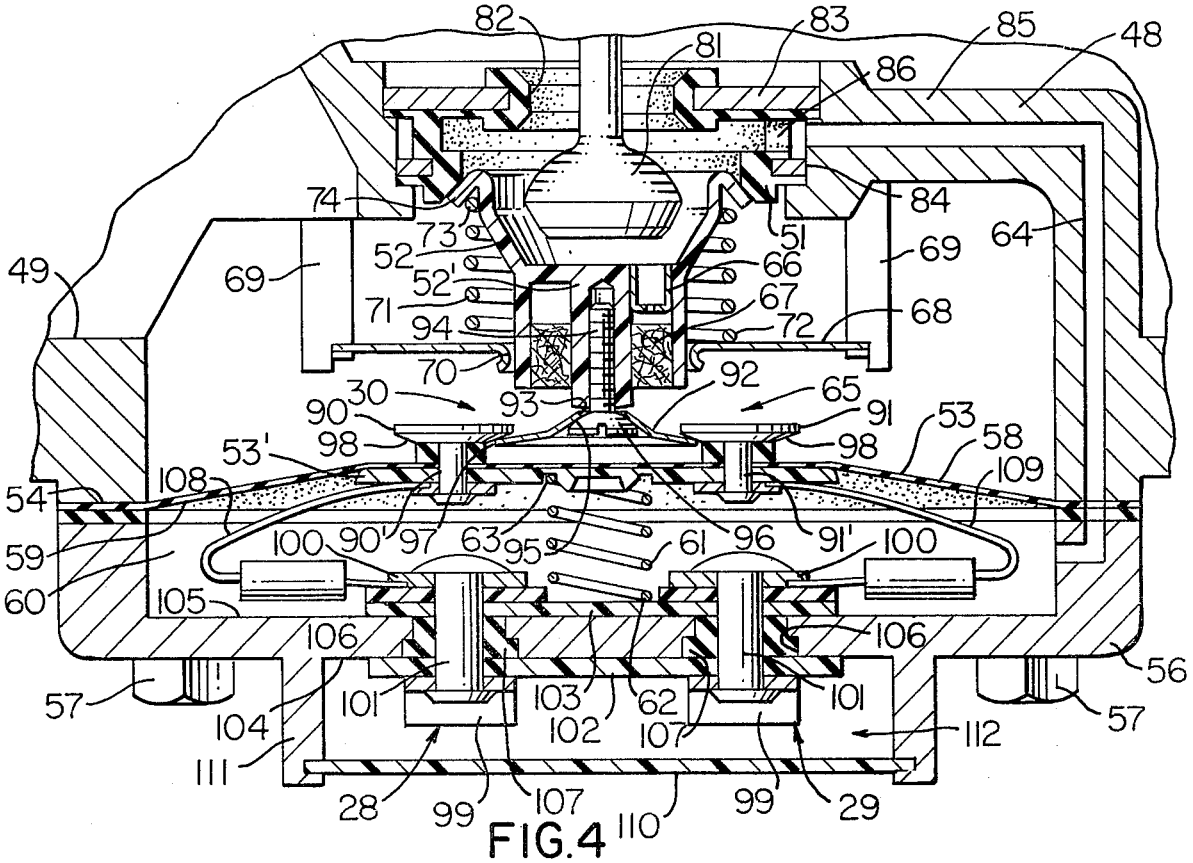
FIG. 4 is a fragmentary view similar to FIG. 3 and illustrates the fluid flow sensing switch device in a different operating condition thereof.
Figure 5:
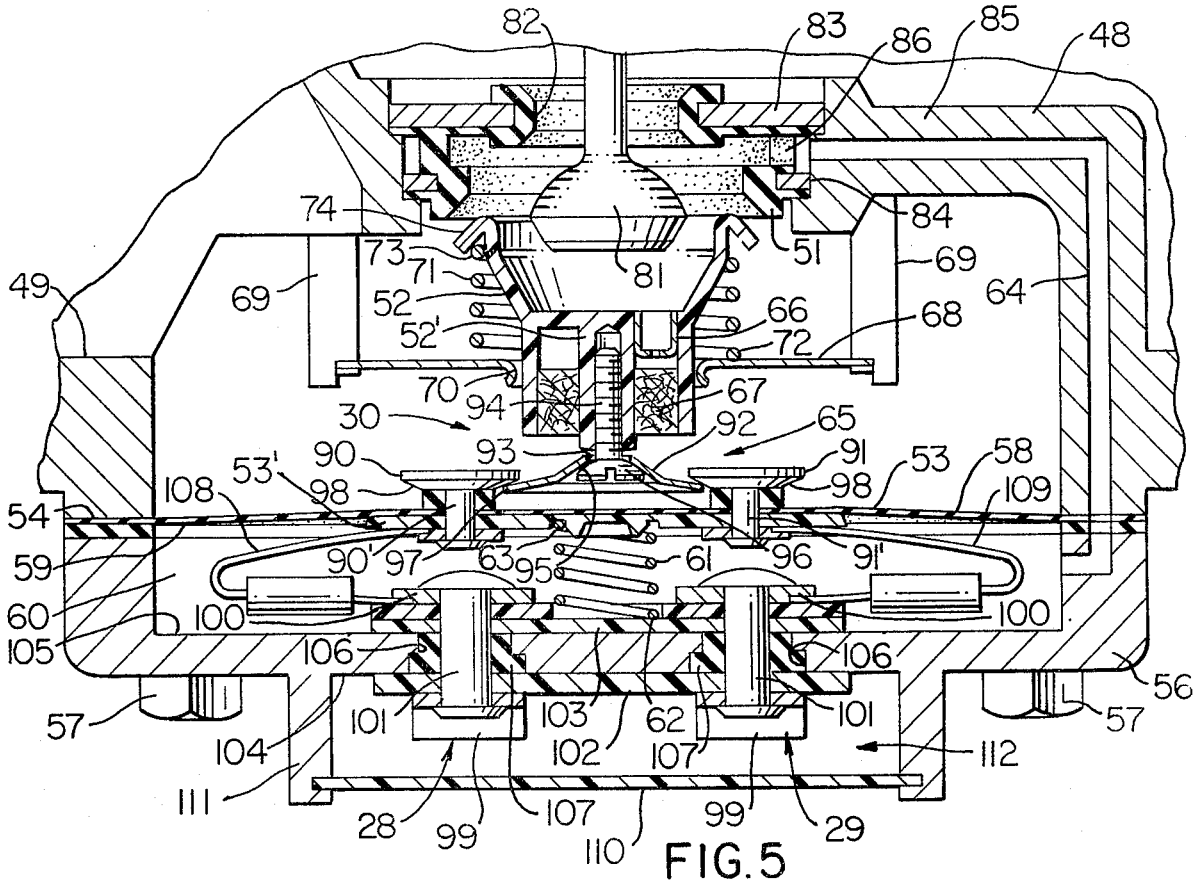
FIG. 5 is a view similar to FIGS. 3 and 4 and illustrates the fluid flow sensing switch device in still another operating condition thereof.

The housing means 48 has a passage 64 therein that leads from the downstream side of the valve seat 51 to the control chamber 60 so that when fuel flows through the open valve seat 51 in a manner hereinafter described, a venturi effect is created by such flow of fuel through the valve seat 51 to the outlet 50 so that the passage 64 and the control chamber 60 are partially evacuated to a certain extent. In this manner, a resulting pressure differential acting across the diaphragm 53 in opposition to the force of the compression spring 61 will cause the diaphragm 53 to move downwardly in the drawings from the position illustrated in FIG. 3 to the position illustrated in FIG. 5 not only for the purpose of closing the contact means, generally indicated by the reference numeral 65, of the switch construction 30 as illustrated in FIG. 4, but also to open the valve member 52 away from the valve seat 51 in a manner hereinafter described and as illustrated in FIG. 5.

The valve member 52 has an intermediate wall 52' provided with an orifice cup 66 to thereby provide a restricted passage between the inlet 49 and the outlet 50 through the valve seat 51 for a purpose hereinafter described, the valve member 52 carrying suitable filter material 67 upstream of the orifice cup 66 to filter the flow of fuel therethrough so as to prevent any dirt or the like from the fuel source 22 clogging the orifice of the orifice cup 66.

A valve guide disc or washer-like member 68 is secured to a plurality of rib means 69 of the housing means 48 and has a central aperture 70 passing therethrough and telescopically receiving the valve member 52 therein so that movement of valve member 52 by the diaphragm 53 in a manner hereinafter set forth is guided by the guide member 68.

Figure 3:
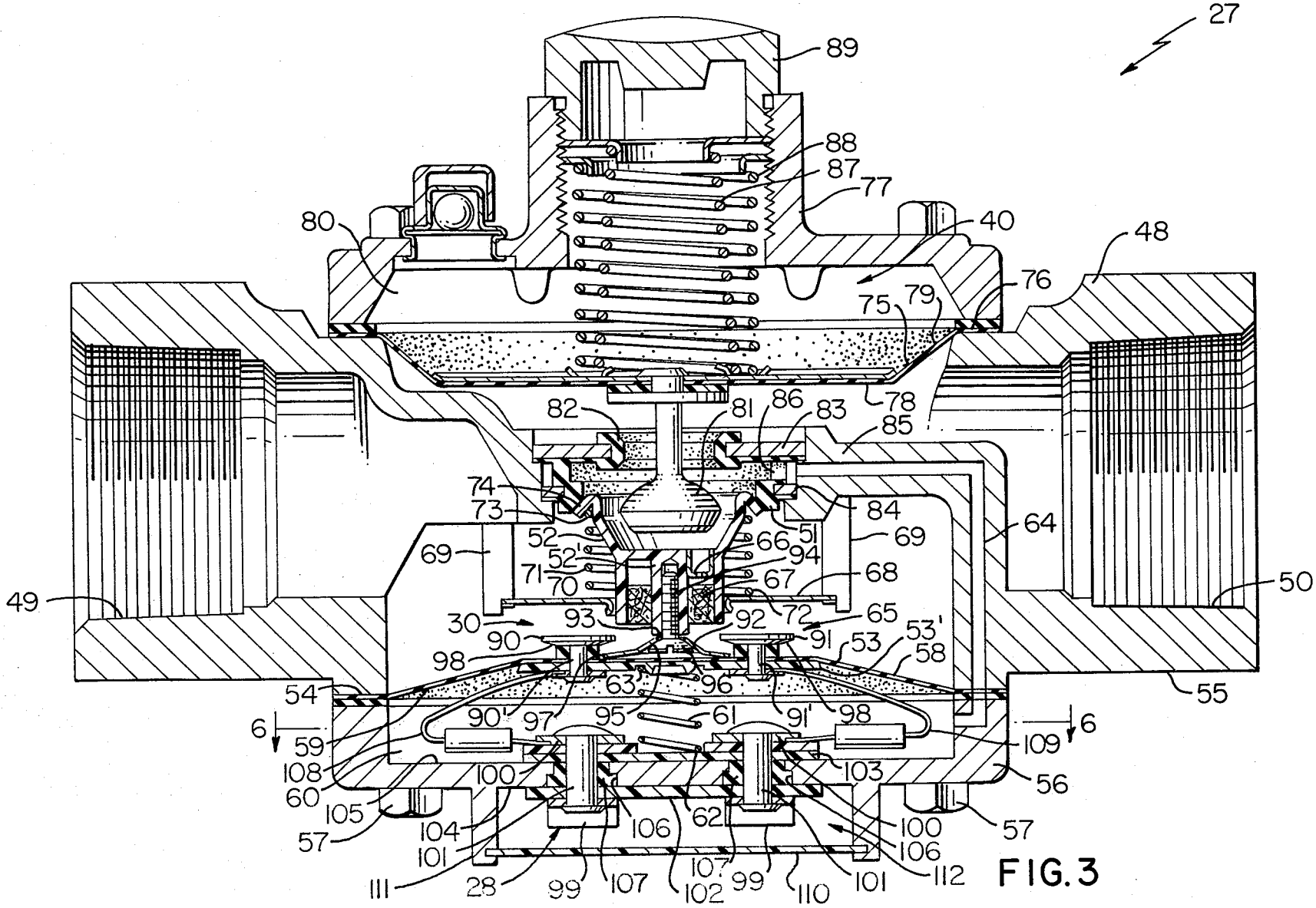
FIG. 3 is an enlarged cross-sectional view taken on line 3—3 of FIG. 2.

A coiled compression spring 71 has one end 72 bearing against the guide member 68 and surrounds the valve member 52 in such a manner that the other end 73 thereof bears against an enlarged end 74 of the valve member 52 so that the force of the compression spring 71 tends to maintain the enlarged end 74 of the valve member 52 in sealing engagement against the valve seat 51 to close the same in the manner illustrated in FIG. 3.

The pressure regulator means 40 that is disposed in the housing means 48 of the device 27 of this invention can be of the type disclosed and claimed in the U.S. Patent to Genbauffe, No. 3,825,029 and comprises a flexible diaphragm 75 having its outer peripheral portion 76 secured between the housing body 55 and another cover member 77 whereby the side 78 of the diaphragm 75 is exposed to the outlet 50 and the other side 79 of the diaphragm 75 cooperates with the cover member 77 to define a chamber 80 therebetween.

The flexible diaphragm 75 carries a valve member 81 adapted to control a valve seat 82 disposed downstream from the main valve seat 51 and leading from the main valve seat 51 to the outlet 50 as illustrated.

Thus, the pressure regulator means 40 will maintain the pressure valve of the fuel that passes through the main valve seat 51 at a predetermined valve in a manner well known in the art.

If desired, the valve seat 82 for the pressure regulator 40 and the main valve seat 51 for the main valve member 52 can comprise a one-piece member 83 secured in any suitable manner in an opening 84 passing through a web portion 85 of the housing body 55, such one-piece structure 83 having an opening 86 that interconnects with the passage 64 so that the passage 64 for the control chamber 60 will be disposed intermediate the valve seats 51 and 82 for a purpose hereinafter described.

A pair of compression springs 87 and 88 are disposed in the chamber 80 for the pressure regulator 40 so as to bear against the diaphragm 75 to tend to urge the valve member 81 to an open position thereof in opposition to the force of the pressure differential acting across the diaphragm 75 when the outlet 50 has a fluid pressure therein as the chamber 80 merely has an atmospheric pressure therein.

When both compression springs 87 and 88 are utilized to act on the diaphragm 75 as illustrated in FIG. 3, the pressure regulator 40 is particularly adapted to act as a pressure regulator for an LPG fuel source whereas only the compression spring 88 is utilized to act on the diaphragm 75 when the fuel source 22 is a natural gas fuel source, the additional spring 87 being stored in a removable cap 89 of the cover member 77 during the use of only the outer spring 88 in the manner fully set forth in the aforementioned U.S. Patent to Genbauffe, No. 3,825,029.

Therefore, further details of the structure and operation of the pressure regulator 40 need not be provided as the aforementioned U.S. Patent to Genbauffe, No. 3,825,029, is incorporated herein by reference to provide any further desired information concerning the details and operation thereof.

The contact means 65 for the switch construction 30 comprises a pair of contacts 90 and 91 carried by the flexible diaphragm 58 and a bridging contact member 92 universally secured to the valve member 52 and being substantially universally mounted thereto.

In particular, the bridging contact member 92 comprises a conductive disc having an opening 93 passing centrally therethrough and telescopically receiving a threaded fastening member 94 secured to the intermediate web 52' of the valve member 52 so that a concave portion 95 of the bridging contact member 92 can swivel on the substantially hemispherical head 96 of the threaded fastening member 94 as illustrated.

The outer peripheral portion 97 of the bridging contact member 92 is adapted to engage against the undersides 98 of the contacts 90 and 91 when the diaphragm 53 is moved downwardly from the position illustrated in FIG. 3 to the position illustrated in FIG. 4 in a manner hereinafter described to cause the contact member 92 to provide an electrical connection between the contacts 90 and 91 for a purpose hereinafter described whereby the contact means 65 of the switch construction 30 are closed as illustrated in FIG. 4.

Further downward movement of the diaphragm 53 from the position illustrated in FIG. 4 to the position illustrated in FIG. 5 causes the pair of contacts 90 and 91, through their engagement with the bridging contact member 92, to pull the valve member 52 downwardly therewith in opposition to the force of the compression spring 71 to open the main valve seat 51 and thereby interconnect the inlet 49 with the outlet 50 for a purpose hereinafter described.

The contacts 90 and 91 are secured in spaced relation to the diaphragm 53 by conductive rivet-like members 90' and 91' which also fasten insulative members 53' to the opposite sides 58 and 59 of the diaphragm 53.

The terminal means 28 and 29 for the device 27 are respectively carried by the cover member 56 of the housing part 48 and each includes a first part 99 formed as a plug-in prong external to the cover member 56 and being electrically interconnected to a second part 100 of the respective terminal means 28 or 29 that is disposed internally of the housing means 48 by a rivet-like electrical connector 101 respectively fastening the parts 99 and 100 to insulating plates 102 and 103 respectively disposed on opposite sides 104 and 105 of the cover member 56. Each rivet-like member 101 passes through opening means 106 of the cover member 56 which is sealed closed by annular sealing means 107 disposed around the respective rivet member 101 as illustrated.

The electrical contacts 90 and 91 are respectively electrically interconnected to the second parts 100 of the terminal means 28 and 29 by flexible lead means 108 and 109 respectively disposed within the control chamber 60 of the device 27 and respectively interconnected to the rivet-like members 90' and 91' for the contacts 90 and 91 and to the rivet-like members 101 for the terminals 28 and 29.

In this manner, it can be seen that all of the switch construction 30, except for the bridging contact member 92, is either carried by the flexible diaphragm 53 or the cover member 56 so that the electrical connection to the device 27 can take place by the terminal means 28 and 29 having the prongs 99 thereof plugged into a suitable socket-like receptacle inserted between the side 104 of the cover member 56 and a smaller cover plate 110 spaced from the side 104 and being fastened to an upstanding three sided rib means 111 of the cover member 56 to define an opening 112, into which such socket-type receptacle can be inserted to respectively interconnected the terminals 28 and 29 to the leads 35 and 31. Thus, the device 27 can be easily interconnected into the system 20 as illustrated in FIG. 1.

Therefore, it can be seen that the fluid flow sensing switch device 27 of this invention can be made by the method of this invention as previously described in a relatively inexpensive manner to operate in a manner now to be described.

When the fluid flow sensing device 27 of this invention is disposed in the fuel control system 20 previously described, and the "on-off" valve 23 is in the "off" condition thereof, it can be seen that the inlet 49 of the device 27 is directly interconnected to the fuel source 22 so that the pressure of the fuel in the inlet 49 is the same as in the control chamber 60 because the outlet 50 is blocked from the burner 21 by the "off" condition of the "on-off" valve 23. In particular, the pressure in the outlet 50 through the restricted passage 66, is the same as in the inlet 49 and therefore, the passage 64 causes the pressure valve in the control chamber 60 to also be the same as in the inlet 49 because the passage 64 leads to the outlet 50. Thus, with the pressure across the diaphragm 53 being equal, the force of the compression spring 61 has moved the diaphragm 53 upwardly to position illustrated in FIG. 3 so that the force of the compression spring 71 can maintain the valve member 52 against the valve seat 51 and the diaphragm 53 against the bridging contact member 92. In this manner, the bridging contact member 92 has its outer peripheral portion 97 completely spaced from the undersurfaces 98 of the contact members 90 and 91 which are held spaced from the side 58 of the diaphragm 53 by the rivet-like conductive members 90' and 91'.

Thus, not only is the valve member 52 held against the valve seat 51 so that fuel cannot flow to the burner means 21, but also the bridging contact member 92 is held away from the pair of contacts 90 and 91 so that the switch construction 30 is in the open condition thereof to prevent the operation of the transformer 26 and, thus, the energizing of the ignition coil 24.

However, when the operator desires to utilize the burner means 21, the operator opens the "on-off" valve 23. The initial opening of the "on-off" valve 23 vents the pressure in the outlet 50 of the device 27 to the burner 21 so that the initial pressure drop between the inlet 49 and outlet 50 results in a corresponding pressure drop across the diaphragm 53 caused by the pressure in the control chamber 60 being evacuated through the outlet 50 and thus being less than in the inlet 49 because the restricted passage 66 cannot maintain the pressure in the outlet 50 at the same rate that is provided in the inlet 49. Thus, the diaphragm 53 is moved downwardly by the resulting pressure differential across the same in opposition to the force of the compression spring 61 until the undersurfaces 98 of the pair of contacts 90 and 91 make contact with the bridging contact member 92 as illustrated in FIG. 4 to cause closing of the switch construction 30 and, thus, operation of the transformer 26 to energize the ignition coil 24 in the manner previously described.

Further downward movement of the diaphragm 53, because of the pressure differential acting across the same, causes the pair of contacts 90 and 91 to pull the bridging contact member 92 downwardly therewith in opposition to the force of the main compression spring 71 which movement, of course, causes the valve member 52 to be pulled away from the valve seat 51 in the manner illustrated in FIG. 5 to permit fuel in sufficient quantity to now flow from the source 22 through the open valve seat 51, pressure regulator means 40 and open valve means 23 to the burner means 21 to be ignited by the igniter coil 24 as the same issues therefrom.

As long as the "on-off" valve 23 remains in the "on" condition thereof, fuel continuously flows from the source 22 to the burner 21 at the pressure determined by the setting of the pressure regulator 40 and since the device 27 remains in the open condition as illustrated in FIG. 5 during this time, the switch construction 30 remains in its closed condition and the ignition coil 24 remains in its energized condition.

The pressure in the control chamber 60 cannot build up to equal the pressure in the inlet 49 as long as the fuel flows through the open valve seat 51 because of the aforementioned venturi effect at the opening 86 for the passage 64 to cause partial evacuation of the pressure in the control chamber 60.

The fuel flowing through the valve seat 51 to the outlet 50 acts on the diaphragm 75 of the pressure regulator means 40 in opposition to the force of the spring 88 or springs 88 and 87 so that the resulting position of the valve member 81 relative to the valve seat 82 determines the pressure value of the fuel that is delivered by the outlet to the burner means 21 in a manner well known in the art.

However, should the operator subsequently close the "on-off" valve 23, the closing of the valve 23 stops the flow of fuel to the burner 21 and now causes the pressure in the outlet 50 of the device 27 to build up, by the fuel still passing through the opened valve seat 51, until the pressure in the outlet 50 and, thus, in the control chamber 60 is substantially the same as the pressure in the inlet 49. In this manner, the pressure differential acting across the diaphragm 53 progressively decreases so that the force of the compression spring 61 first causes the diaphragm 53 to move upwardly and cause the valve member 52 to close against the valve seat 51 in the manner illustrated in FIG. 4. Further upward movement of the diaphragm 53 by the force of compression spring 61 then causes the pair of contacts 90 and 91 to move away from the bridging contact member 92 in the manner illustrated in FIG. 3 to thereby open the switch construction 30 and terminate the operation of the transformer means 26 whereby the ignition coil 24 is now deenergized.

Thus, as long as the "on-off" valve 23 remains in the "off" condition thereof, the pressure in the outlet 50 remains the same as the pressure in the inlet 49 because of the restricted passage 66 whereby the diaphragm 53 remains in the up condition illustrated in FIG. 3 so that not only is the valve member 52 in its closed condition against the valve seat 51, but also the switch construction 30 is in the opened condition thereof.

Therefore, it can be seen that not only does the location of the contact means 65 of the switch construction 30 in the inlet 49 of the fluid flow passage of the device 27 render the device 27 relatively compact, but also such arrangement of the contact means 65 readily permits the fluid flow sensing switch device 27 to close the switch construction 30 before the valve member 52 thereof is moved to an open condition relative to the valve seat 51 as set forth in the aforementioned copending patent application, Ser. No. 936,112. Conversely, the location of the contact means 65 permits the valve member 52 to close before the switch construction 30 is opened as also set forth in the aforementioned copending patent application, Ser. No. 986,112.

Further, by forming the contact means 65 as a pair of spaced apart contacts 90 and 91 carried by the diaphragm 53 in accordance with the teachings of this invention, it can be seen that the terminals 28 and 29 for the system 20 can be carried by the cover member 56 of the housing means 48 to permit the electrical connection leads 108 and 109 to be disposed in the control chamber 60 so that the main housing body 55 need not carry any terminal means thereof in the fluid flow path therethrough as provided in the prior described fluid flow sensing switch device.

Figure 7:
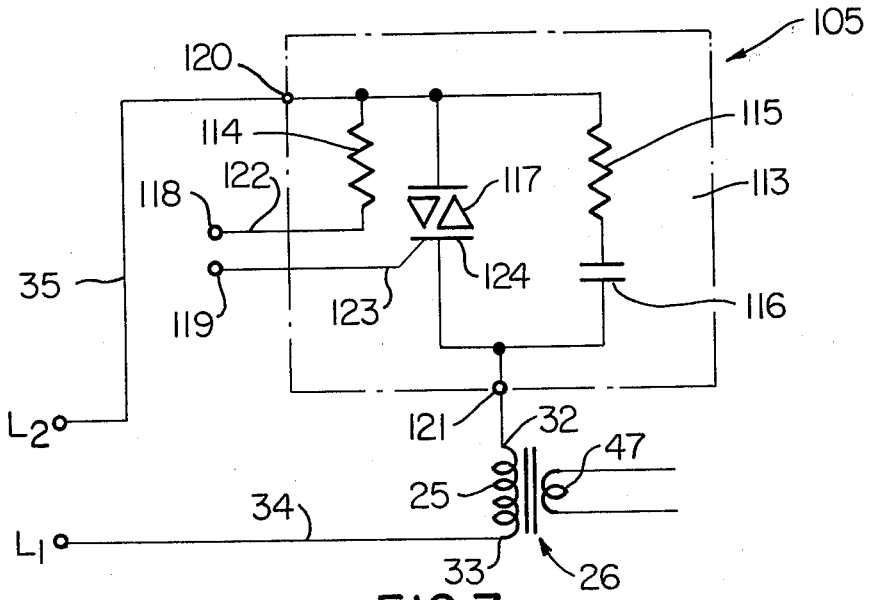
FIG. 7 is a schematic view of the electronic switching means that can be utilized with the fluid flow sensing switch device of FIGS. 2–6.

As previously stated, the system 20 of this invention can utilize the electronic switching means 105 of FIGS. 1 and 7 if desired, the electronic switching means 105 being fully disclosed and claimed in the aforementioned copending patent application, Ser. No. 936,116.

In particular, the electronic switching means 105 as illustrated in FIG. 7 can comprise a potted unit 113 that contains therein a pair of electrical resistors 114, 115, a capacitor 116 and a triac 117 electrically interconnected as illustrated in FIG. 7 so that four terminals 118, 119, 120 and 121 extend therefrom to be electrically interconnected in the leads 31 and 35 of the system of FIG. 20 of FIG. 1.

For example, the terminal 120 of the unit 113 is interconnected to the lead 35 that extends from the power source lead L2 to the unit 113 while the remaining portion of the lead 35 that extends from the unit 113 to the terminal 28 of the fluid flow sensing switch device 27 is interconnected to the terminal 118.

The terminal 121 of the electronic switching unit 113 is interconnected to the portion of the lead 31 that extends from the unit 113 to the side 32 of the primary coil 25 of the transformer 26 while the terminal 119 thereof is interconnected to the portion of the lead 31 of FIG. 1 that extends between the unit 113 and the terminal 29 of the device 27.

As illustrated in FIG. 7, it can be seen that the terminal 118 of the unit 105 is electrically interconnected by lead means 122 to the resistor 114 while the terminal 119 is interconnected by lead means 123 to the gate 124 of the triac 117 which will interconnect the power source lead L2 through the triac 117 to the side 32 of the primary coil 25 of the transformer 26 when the terminals 118 and 119 are interconnected together which happens when the switch construction 30 of the fluid flow sensing switch device 27 of this invention closes for the reasons previously set forth.

Therefore, it can be seen that a relatively small current, because of the resistor 114, will flow through the electrical switch 30 of the device 27 when the contact means 65 thereof are closed in the manner previously described so that arcing between the opening and closing of the contact means 65 of the switch means 30 is held to an absolute minimum to prevent carbon buildup thereon for the reasons advanced in the aforementioned copending patent application, Ser. No. 936,116, while permitting the electronic switching means 105 to interconnect the high voltage, high current power source leads L1 and L2 together through the primary coil 25 of the transformer 26 when the triac 117 senses an electrical current at the gate 124 thereof by the electrically interconnecting together of the terminals 118 and 119.

While the system 20 illustrates the electronic switching means 105 being remote from the device 27 and external thereto so as to be located anywhere on the cooking apparatus as desired, it is a feature of this invention to incorporate the electronic switching means 105 in the housing means 48 of the fluid flow sensing switch device 27 of this invention in the manner also set forth in the copending patent application, Ser. No. 936,113.

Figure 6:
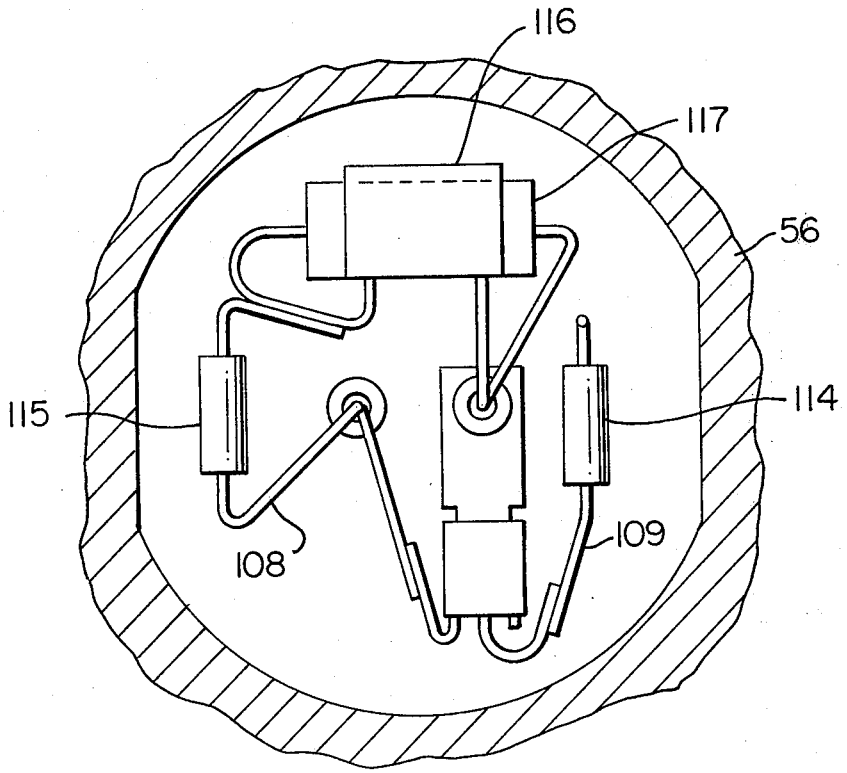
FIG. 6 is a cross-sectional view of the fluid flow sensing switch device of FIG. 3 and is taken in the direction of the arrows 6—6 thereof.

In particular, as illustrated in FIGS. 3 and 6, the lead means 108 and 109 that are disposed in the control chamber 60 have the components 114, 115, 116 and 117 of the electronic switching means 105 incorporated therein so that such electronic switching components 114–117 not only are disposed within the housing means 48 of the device 27, but also such components 114–117 are carried by the cover member 56 and flexible diaphragm 53 so as to be removable therewith for easy repair and replacement services as previously described.

Therefore, it can be seen that the fluid flow sensing switch device of this invention and method of making the same as illustrated readily permits the electronic switching means 105 to be utilized in combination with the electrical switch 30 thereof while being contained in the same housing 48 therewith to accomplish the unique function thereof as illustrated in FIGS. 1 and 7 and as set forth in the aforementioned copending patent application, Ser. No. 936,116.

In addition, it can be seen that by forming the housing means 48 of this invention to have the inlet means 49 and outlet means 50 disposed in aligned relation and by having the pressure regulator means 40 and main valve member 52 disposed in aligned relation transverse to the aligned inlet 49 and outlet 50, the overall size of the housing means 48 is relatively compact yet permits a complete pressure regulation of the fuel flowing therethrough and operation of the switch construction 30 for the reasons previously set forth.

Therefore, it can be seen that this invention not only provides an improved fluid flow sensing switch device and method of making the same, but also this invention provides an improved fuel control system utilizing such a fluid flow sensing switch device.

While the form and methods of this invention, now preferred, have been illustrated and described as required by the Patent Statutes, it is to be understood that other forms and method steps can be utilized and still fall within the scope of the appended claims.

What is claimed is:

1. In a fluid flow sensing switch device having a self-contained housing means provided with a fluid flow passage therethrough defined by an inlet for receiving a fluid and an outlet disposed in spaced coaxially aligned relation in said housing means and separated by a main valve seat controlled by a movable main valve member that has means adapted to be operated by a pressure differential that is adapted to be created between said inlet and said outlet, said device having an electrical switch construction operatively associated with said main valve member and having contact means thereof adapted to be actuated by said pressure differential, the improvement comprising a pressure regulator disposed in said housing means for regulating the pressure of said fluid that passes from said inlet to said outlet of said housing means, said pressure regulator being disposed downstream from said main valve seat so as to act on said fluid after the same passes through said main valve seat from said inlet, said pressure regulator having a valve seat and a valve member for controlling said valve seat thereof, said valve seat of said pressure regulator and said main valve seat being disposed in spaced coaxially aligned relation in said housing means and substantially transverse to the coaxially aligned inlet and outlet.

2. A device as set forth in claim 1 wherein said valve seat of said pressure regulator and said main valve seat comprise a one-piece member formed separately from said housing means and disposed therein.

3. A device as set forth in claim 1 wherein said pressure regulator has a flexible diaphragm interconnected to said valve member of said pressure regulator and being exposed to the fluid pressure in said outlet so as to be responsive thereto.

4. A device as set forth in claim 3 wherein a main flexible diaphragm is carried by said housing means and is operatively interconnected to said contact means to control said contact means, said main diaphragm being exposed to fluid pressure in said inlet on one side thereof and to fluid pressure in said outlet on the other side thereof.

5. A device as set forth in claim 4 wherein said housing means cooperates with said other side of said main diaphragm to define a chamber therebetween, said housing means having a passage means leading from said outlet intermediate said valve seat of said pressure regulator and said main valve seat to said chamber.

6. A device as set forth in claim 5 wherein said passage means interrupts said one-piece member intermediate said valve seats thereof.

7. In a method of making a fluid flow sensing switch device having a self-contained housing means provided with a fluid flow passage therethrough defined by an inlet for receiving a fluid and an outlet disposed in spaced coaxially aligned relation in said housing means and separated by a main valve seat controlled by a movable main valve member that has means adapted to be operated by a pressure differential that is adapted to be created between said inlet and said outlet, said device having an electrical switch construction operatively associated with said main valve member and having contact means thereof adapted to be actuated by said pressure differential, the improvement comprising the steps of disposing a pressure regulator in said housing means for regulating the pressure of said fluid that passes from said inlet to said outlet of said housing means, disposing said pressure regulator downstream from said main valve seat so as to act on said fluid after the same passes through said main valve seat from said inlet, forming said pressure regulator with a valve seat and a valve member for controlling said valve seat thereof, and forming said valve seat of said pressure regulator and said main valve seat to be disposed in spaced coaxially aligned relation in said housing means and be substantially transverse to the coaxially aligned inlet and outlet.

8. A method as set forth in claim 7 and including the step of forming said valve seat of said pressure regulator and said main valve seat as a one-piece member that is separate from said housing means and to be disposed therein.

9. A method as set forth in claim 7 and including the step of forming said pressure regulator with a flexible diaphragm that is interconnected to said valve member of said pressure regulator and is exposed to the fluid pressure in said outlet so as to be responsive thereto.

10. A method as set forth in claim 9 and including the steps of disposing a main flexible diaphragm in said housing means, operatively interconnecting said main diaphragm to said contact means to control said contact means, and exposing said main diaphragm to fluid pressure in said inlet on one side thereof and to fluid pressure in said outlet on the other side thereof.

11. A method as set forth in claim 10 and including the steps of forming said housing means to cooperate with said other side of said main diaphragm to define a chamber therebetween, and forming said housing means with a passage means leading from said outlet intermediate said valve seat of said pressure regulator and said main valve seat to said chamber.

12. A method as set forth in claim 11 and including the step of forming said passage means to interrupt said one-piece member intermediate said valve seats thereof.

13. In a fuel control system having an electrically operated ignition means, a fuel source and a burner means for receiving fuel from said source through a passage defining means to be ignited by said electrically operated ignition means, said passage defining means having a fluid flow sensing switch device therein that comprises a self-contained housing means provided with a fuel flow passage therethrough defined by an inlet for receiving said fuel and an outlet disposed in spaced coaxially aligned relation in said housing means and separated by a main valve seat controlled by a movable main valve member that has means adapted to be operated by a pressure differential that is adapted to be created between said inlet and said outlet, said device having an electrical switch construction operatively associated with said valve member and having means adapted for operating said ignition means, said means of said switch construction comprising contact means thereof adapted to be actuated by said pressure differential, the improvement comprising a pressure regulator disposed in said housing means for regulating the pressure of said fuel that passes from said inlet to said outlet of said housing means, said pressure regulator being disposed downstream from said main valve seat so as to act on said fuel after the same passes through said main valve seat from said inlet, said pressure regulator having a valve seat and a valve member for controlling said valve seat thereof, said valve seat of said pressure regulator and said main valve seat being disposed in spaced coaxially aligned relation in said housing means and substantially transverse to the coaxially aligned inlet and outlet.

14. A system as set forth in claim 13 wherein said valve seat of said pressure regulator and said main valve seat comprises a one-piece member formed separately from said housing means and disposed therein.

15. A system as set forth in claim 13 wherein said pressure regulator has a flexible diaphragm interconnected to said valve member of said pressure regulator and being exposed to the fuel pressure in said outlet so as to be responsive thereto.

16. A system as set forth in claim 15 wherein a main flexible diaphragm is carried by said housing means and is operatively interconnected to said contact means to control said contact means, said main diaphragm being exposed to fuel pressure in said inlet on one side thereof and to fuel pressure in said outlet on the other side thereof.

17. A system as set forth in claim 16 wherein said housing means cooperates with said other side of said main diaphragm to define a chamber therebetween, said housing means having a passage means leading from said outlet intermediate said valve seat of said pressure regulator and said main valve seat to said chamber.

18. A system as set forth in claim 17 wherein said passage means interrupts said one-piece member intermediate said valve seats thereof.

* * * * *